United States Patent [19]

Schwing et al.

[11] 4,280,771

[45] Jul. 28, 1981

[54] APPARATUS FOR DISTRIBUTING CONCRETE, ESPECIALLY IN THE SHUTTERING OF GALLERY LININGS IN MINE AND TUNNEL WORKINGS

[75] Inventors: Friedrich W. Schwing, Herne; Karl-Ernst von Eckardstein, Kamen, both of Fed. Rep. of Germany

[73] Assignee: Friedrich Wilh. Schwing GmbH, Fed. Rep. of Germany

[21] Appl. No.: 960,176

[22] Filed: Nov. 13, 1978

[30] Foreign Application Priority Data

Nov. 25, 1977 [DE] Fed. Rep. of Germany ..... 2752605

[51] Int. Cl.[3] ..... E21D 11/10

[52] U.S. Cl. ..... 405/150; 405/148; 405/268

[58] Field of Search ..... 405/146, 148, 150, 266, 405/268

[56] References Cited

U.S. PATENT DOCUMENTS

| | | | |
|---|---|---|---|
| 3,224,203 | 12/1965 | Brannfors et al. | 405/150 |
| 3,828,862 | 8/1974 | Dabell | 405/150 X |

FOREIGN PATENT DOCUMENTS

| | | | |
|---|---|---|---|
| 2361968 | 6/1975 | Fed. Rep. of Germany | 405/150 |
| 570714 | 9/1977 | U.S.S.R. | 405/150 |

*Primary Examiner*—David H. Corbin

*Attorney, Agent, or Firm*—Remy J. VanOphem

[57] ABSTRACT

An apparatus for distributing concrete, especially in the shuttering of gallery linings in mining and tunnel workings, comprises a transportable distribution mast carrying an articulated conduit for conveying concrete which is pivoted on a column which can rotate around its axis. The mast comprises a swivel extension forming the end section thereof, and a main boom which connects the column to the swivel extension, the swivel extension being foldable from above onto the main boom. The main boom is divided into several mast sections joined together by power-operated pivotal connections so that the mast is articulatable in a swivel plane containing the column axis, the range of relative pivotal movement between the mast sections being such that the main boom may be extended upwardly and forwardly from the folded position of the mast sections, with the swivel extension in its folded position, the power-operated pivotal connections of the main boom being disposed below the folded swivel extension.

7 Claims, 12 Drawing Figures

APPARATUS FOR DISTRIBUTING CONCRETE, ESPECIALLY IN THE SHUTTERING OF GALLERY LININGS IN MINE AND TUNNEL WORKINGS

BACKGROUND OF THE INVENTION

The invention relates to an apparatus for distributing concrete, especially in shuttering of gallery linings in mine and tunnel workings with the aid of a travelling or transportable distribution mast carrying an articulated conduit for carrying concrete. The mast is pivoted on a column which can rotate around its axis and which is divided into several mast sections joined together by power-operated pivotal joints so as to be articulatable in a swivel plane containing the column axis. Thus, a swivel extension forming the end section of the mast can fold from above onto a main boom which connects the column to the swivel extension.

In mining and tunnel workings, a concrete lining is often applied directly to the rock. The shuttering or cover required for this extends longitudinally of the gallery and often comprises a transportable framework which is called a "shuttering cart". Logically the longest possible shuttering length is desired. By this, on the one hand, the number of transfer operations of the shuttering cart are reduced, and on the other hand, the total length of the end shuttering, which prevents extrusion of concrete at the front end of the shuttering, is shortened.

In the longitudinal direction of the gallery and in the peripheral direction, the shuttering of this kind should feature several closable filler openings in order that the shuttered-off mould cavity may be filled in an even manner, beginning at both ends and finally, in the roof area. Thus, in the case of large cross-section galleries, one-sided loading of the shuttering and the shuttering cart are avoided. However, with such an arrangement the nozzle of the concrete conduit must be attached and detached many times, and, because of the differing positions of the filler openings, considerable movement of the concrete conduit has to take place between these procedures. The amounts of concrete to be filled in each position of the concrete conduit differ but are, however, relatively small. On the other hand, large diameter conduits are often necessary, especially when large granular rubble occurring during the workings is used as an addition to the concrete.

An apparatus of the kind described in the introduction serves to facilitate and expedite the work procedures which are necessary to fill the mould cavity of the described shuttering. In known apparatus of this kind, the mast carrying the concrete conduit has two arms. One of the arms is hinged to the column, and the second arm is attached to the first arm by means of a universal joint and forms the swivel extension. The mast forms a special superstructure for a lorry which also features a concrete pump and a filling hopper to which the concrete may be delivered by travelling mixers.

Gallery heights have been for some time at a maximum of 12–14 meters, so that a relatively long mast is necessary. However, since the total length of the known masts is only divided into two mast sections, the rotational movability of the mast sections can only be exploited to a limited degree.

For this reason, the shuttering, with the known apparatus, must be filled from the end side. With the desirable long shutterings, the filling procedure demands the moving of the vehicle which must thus be provided with heavy suspended rollers on its swivelable supports as well as a disproportionately large filling hopper for a supply of concrete during the time of travelling when topping-up by the travelling mixers is not possible. The mode of operation, which is possible with such apparatus, is disadvantageous because the concrete conduit must be manipulated below the unlined, or only provisionally secured rock. The vehicle is unusually heavy and technically complicated.

For a long time, lorries with special superstructures for the distribution of concrete have been employed for construction and excavation workings. One of the distribution masts developed for this has a main boom divided into two mast sections. The power-operated joint between the two sections has a range of pivotal movement which, at least, permits positioning of the mast sections to extend upwards and forwards (German Auslegeschrift No. 2,000,382). The two mast sections forming the main boom are so arranged that the swivel extension can be folded between these two mast sections. For this reason, the two mast sections have approximately the same length as the swivel extension, and the power-operated joint connecting the two sections lies in front of the end of the swivel extension in the collapsed condition of the mast.

A distribution mast of this kind is not suitable for spatially restricted conditions which are encountered in mine and tunnel workings, because the unfolding of the mast with the required length of mast demands too great a height. Thus, its power operated joints can not be controlled so that under such restricted conditions as in mines and tunnels, the vehicle can not remain stationary between successive filling operations.

Because of such difficulties with the employment of distribution masts intended for construction and excavation work, devices have become known, in construction and excavation work for the distribution of concrete (Austrian patent specification No. 251022) in which the concrete conveyor conduit is laid on several rail vehicles and features a telescopic end piece which can be connected to branch pads on the shuttering. These known devices however, do not usually function particularly well because the extension pieces at the end of the concrete conduit become restricted because of the encrustations of cement forming there, and must be cleaned frequently. Besides such devices take up a lot of room which is urgently needed in driving galleries.

The object of the invention is to provide apparatus for the distribution of concrete with a distribution mast, so that the mast, which is folded in the transporting position as stated in the introduction, can be unfolded to a required length under restricted conditions, such as are encountered in mining and tunnel workings, so that by controlling the power-operated joints with the mast stationary, the end piece of the concrete conveyor conduit can be brought into a plurality of positions in which it can be connected in succession to the filler branches of the shuttering.

SUMMARY OF THE INVENTION

According to the invention there is provided an apparatus for distributing concrete, especially in the shuttering of gallery linings in mining and tunnel workings, having a travelling or transportable distribution mast carrying an articulated conduit for conveying concrete. The mast is pivoted on a column which can rotate around its axis. The mast is also divided into several mast sections joined together by power-operated pivotal connections so that the mast is articulatable in a swivel plane containing the column axis. The mast also has a swivel extension forming the end section of the mast and a main boom which connects the column to the swivel extension. The swivel extension is foldable from above onto the main boom, and the main boom is divided into several mast sections. The range of relative pivotal movement between the several mast sections is such that the main boom may be extended upwardly and forwardly from the folded position of the mast sections. With the swivel extension in its folded position, the power-operated pivotal connections of the main boom being disposed below the folded swivel extension.

By dividing the main boom with several power-operated joints, it is possible to employ the main boom for lifting and/or horizontally moving the swivel extension by actuating several or all these joints. By arranging these joints entirely below the swivel extension, the swivel extension only needs to be slightly raised in order to unfold the mast, essentially only by the length of a section of the main boom. As these lengths are merely a matter of choice, the mast can be used for varying dimensions of underground chambers, without alteration.

The invention has the advantage that the concrete conveyor conduit can be joined entirely with rotational joints, which are hardly affected by the action of concrete. The mast can be erected at a favourable place, e.g. at the side of the gallery, and takes up very little space. It does not require moving or transporting over considerable periods. For this reason, transportable supports and devices for storing larger amounts of concrete in the apparatus are eliminated.

The space needed for unfolding the mast can be further reduced if the range of pivotal movement of the pivotal connection between the main boom and the column may extend below the horizontal. In this embodiment of the invention, the total necessary height for unfolding the mast is reduced by lowering the main boom.

If the reach of the mast is to be increased, this can be done by increasing the number of mast sections joined together in the main boom. It is then recommended to proceed so that further mast sections are provided between mast sections connected to the column and the swivel extension, which further mast sections can be brought in line with, or folded down onto, the mast sections going before them.

Considerably more freedom is obtained for the erection of the mast in a suitable place in the gallery if the swivel extension is divided by a rotational joint the swivel axis of which is aligned with the longitudinal axis of an end portion of the conduit for conveying concrete, and if an end section of the concrete conveying conduit connected to the swivel extension is rotationally movable about said swivel axis. It is then possible, by actuating the rotational joint, to traverse the periphery of the shuttering with the end section and, by extending or retracting the mast to reach the filler openings lying one behind the other in the longitudinal direction of the gallery.

Details, further characteristics and other advantages of the invention will emerge from the following description of preferred embodiments.

DETAILED DESCRIPTION OF THE PREFERRED EMBODIMENTS

Figure 1:
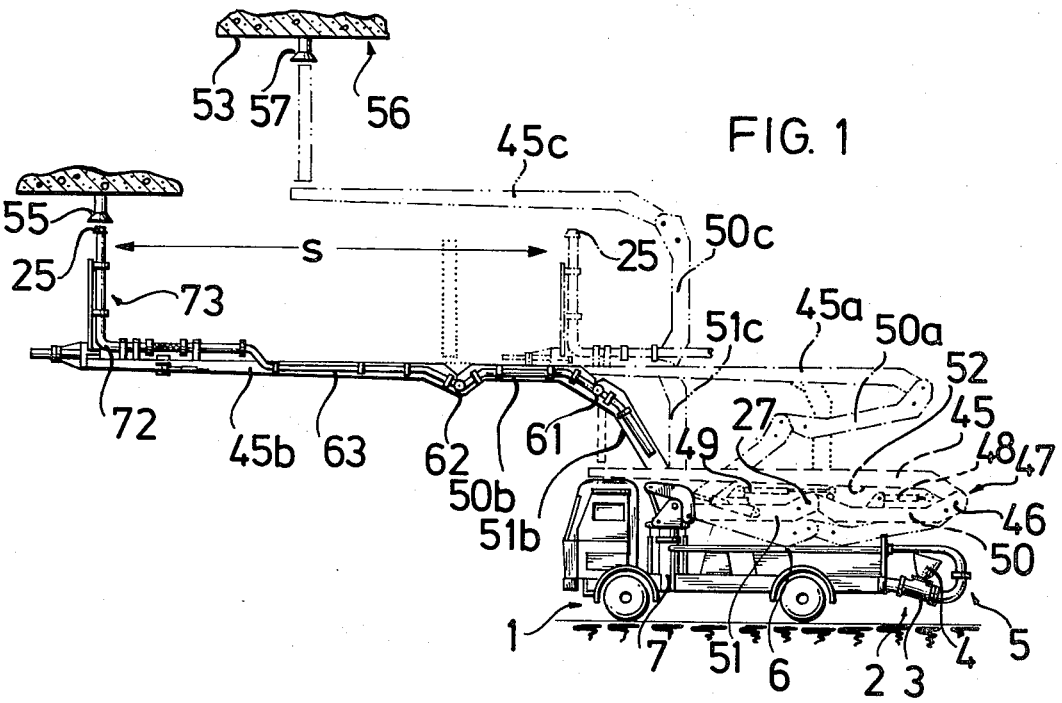
FIG. 1 shows an apparatus according to the invention in side view of the preferred embodiment of the distribution mast, which is shown in various positions.

In the embodiment of FIG. 1, the apparatus consists of a special superstructure for a normal lorry 1 so that the apparatus is transportable. For better understanding of the invention, all non-essential details have been omitted. A concrete supply device 2 comprises a concrete pump 3 with a filler hopper 4, which hopper can, for example, be filled by a travelling mixer (not shown). A concrete conveyor conduit, indicated generally at 5, extends from the concrete pump 3. A first section 6 of the conduit is firmly attached to the superstructure and ends in a column 7. Details of the column can be seen in FIGS. 9 and 9*a*.

Figure 9:
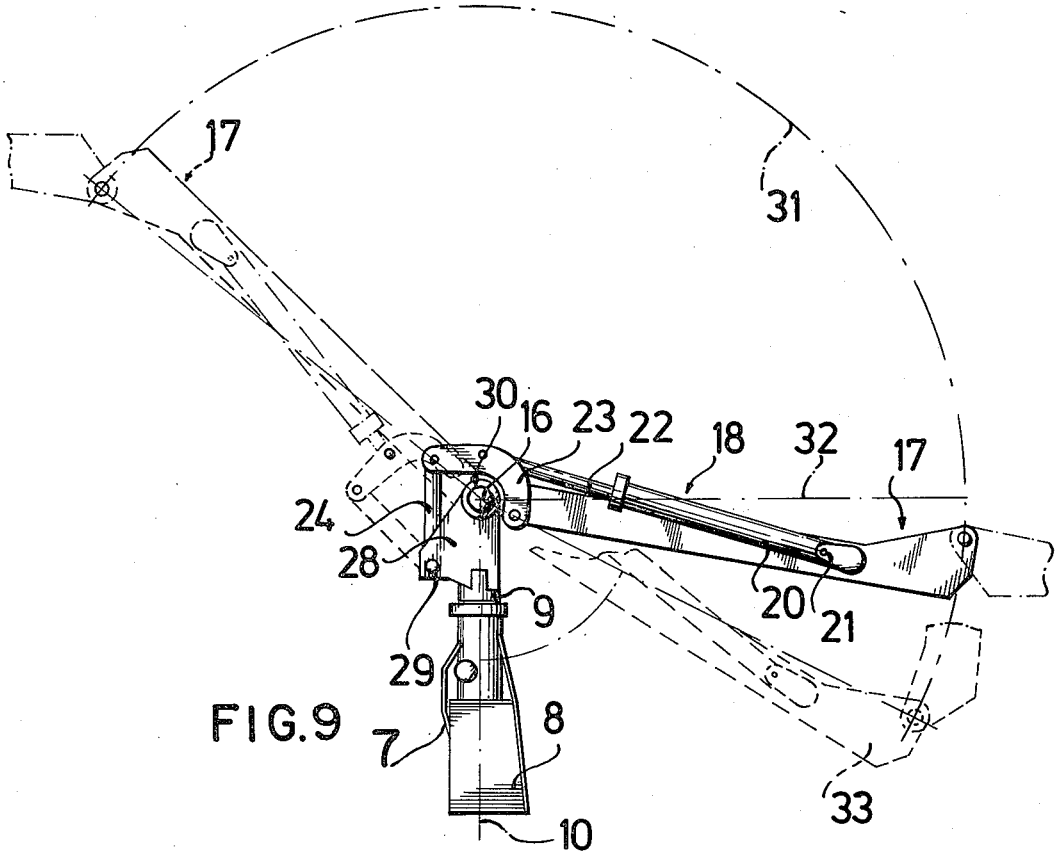
FIG. 9 is an illustration of the rotational joint with which the mast is connected to the column in plan view.
Figure 9A:
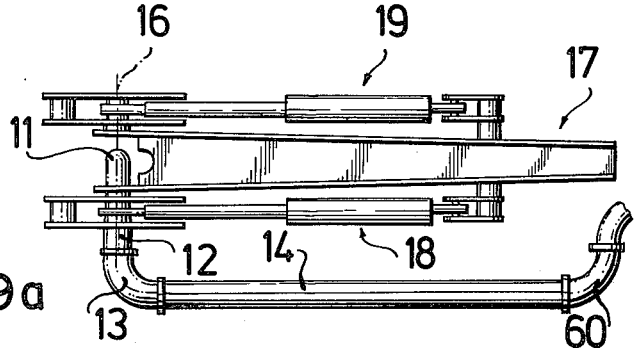
FIG. 9*a* is a top view of FIG. 9.

As shown in FIGS. 9 and 9*a*, the column 7 has a lower fixed foot 8 and an upper rotatable part 9, the rotational axis of which is indicated at 10. A conduit section 11, extending vertically from the conduit section 6, is positioned along the column axis and ends in a bend 12 which passes into a straight pipe section 14 by way of a further bend 13. In the section 11, a rotational pipe joint is pivoted, the axis of which coincides with the axis 10 of the column 7. Between the bend 12 and the bend 13, there is a further rotational joint having a horizontal axis indicated at 16. The horizontal axis 16 is also the axis of a rotational joint 30 by means of which a mast, indicated generally at 17, is connected to the upper part 9 of the column 7. To swivel the mast there are provided two parallel acting rams 18 and 19, respectively, which are identically arranged so that it suffices to describe the parts cooperating with the ram 18 in further detail.

The cylinder 20 of the ram is connected to the mast 17 at 21, while the piston rod 22 is connected to a shift lever 23. Lever 23 is connected to a steering element 24 which is mounted on a bracket 28 at 29. The bracket 28 carries the rotational mast joint 30 the rotational axis of which is shown at 16. Two possible alternative mast positions are shown in dotted lines, and a dash-dotted line 31 shows a part of the swivel area swept by the mast by swinging movement about the rotational mast joint 30. As can be seen, the mast 17 can be swung beneath the horizontal 32, the extreme position lying below the horizontal being shown at 33.

Figure 8:
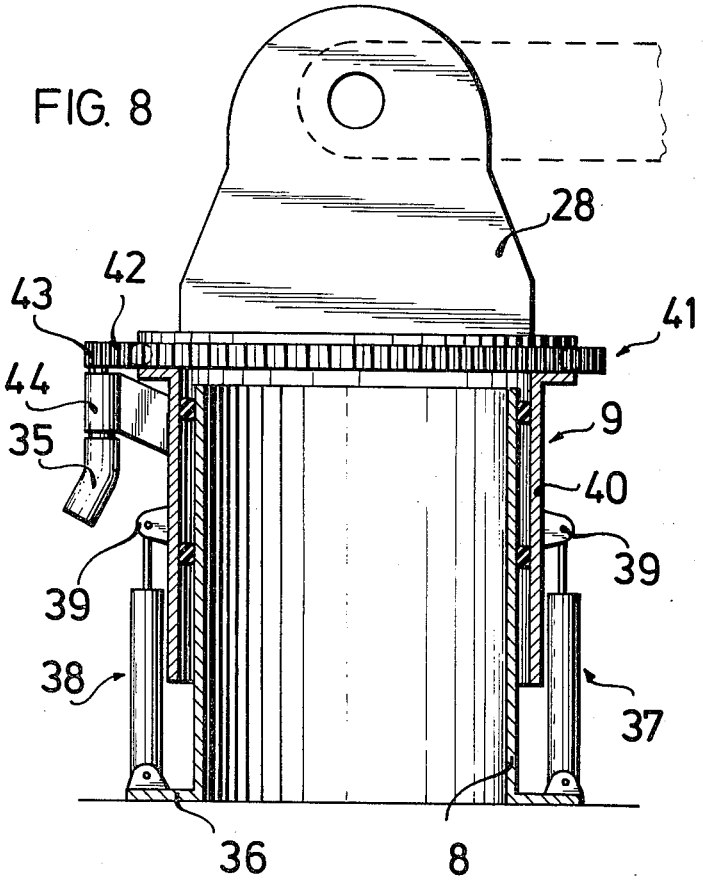
FIG. 8 is a side view of the height-adjustable column of the apparatus of FIG. 1.

An alternate embodiment of the column 7 is shown in FIG. 8. In this embodiment, the fixed lower part 8 of the column is in the form of a hollow cylinder with a flange 36 for attachment of rams 37, 38, the piston rods of which are fastened to brackets 39 which are carried on a hollow cylinder 40. The hollow cylinder 40 is guided in several places on the lower part 8 of the column and forms the upper part 9 of the column 7. The hollow cylinder 40 carries, on ball-bearings, a rotatable ring 41 which has external teeth 42 which engage with a pinion 43 which is driven by a hydraulic motor 44 the feed of which is shown at 35. The length of the column can be adjusted by means of the rams 37 and 38. The hydraulic motor 44 is used to effect mechanical rotation of the upper part 9 of the column, that is, the rotation of the bracket 28 to which the mast sections are connected.

In the embodiment of FIG. 1, the mast 17 comprises a swivel extension 45 which is connected to a main boom, generally indicated at 47, by means of a pivotal joint 46. The pivotal joint 46 can be controlled just as the joint 30, described in connection with the column 7, and a further rotational joint 27 (described below). The joints are power-operated joints which permit various angles between the mast sections, in various swivel positions of the mast sections connected by them. Such power-operated joints are known and are generally actuated by rams, in the present embodiment the ram of the joint 46 being shown at 48 and the ram of the joint 27 at 49.

The power-operated joint 27 divides the main boom into two mast sections 50 and 51, the first mast section 51 being connected to the column 7 by the power-operated joint 30, and the second mast section 50 being connected to the swivel extension 45 by the joint 46.

The power-operated joints 27, 30 and 46 are rotational joints with one axis of freedom and thus enable only swivelling in one swivel plane. The swivel plane is vertical, i.e. it contains the column axis 10. The joints 27 and 46 also possess a definite range of pivotal movement. Shown in dashed lines in FIG. 1 is a position of the mast in which the swivel extension 45 of the main boom 47 is folded down from above and runs forwards, the power-operated joint 27 being disposed below the underside 52 of the folded-down swivel extension.

With the swivel extension 45 folded down, the mast is in the transport position. In this position, the mast sections can be transported with the smallest demands on space. If the mast is to be unfolded, the power-operated joint 27 is first lowered in the direction of the vehicle superstructure (because of the possible position 33 of the section 51) to the lowest position in chain lines in FIG. 1. The mast section 50 is then brought into the position 50*a* by actuation of the power-operated joints. With this, the swivel extension 45 is raised into the position shown at 45*a* and is simultaneously pushed forwards. If it is supposed that in the position of the parts shown at 50*a* and 45*a*, the nozzle 25 of the concrete conveyor conduit stands at the correct height for connecting to a branch (not shown) of a shuttering 53, then by further swinging forwards of the two mast sections into the position 50*b* and 51*b*, the nozzle 25 can be moved a horizontal distance S so as to reach a further filler branch 55. As can be seen, in this, a height adjustment of the swivel extension 45 is not involved until reaching the position 45*b*.

On the other hand, by bringing the mast sections into a vertical position of reach, shown at 50*c* and 51*c*, the swivel extension can be brought into a higher position, indicated at 45*c*, where it reaches, for example, a filler branch 57 fitted in a ridge 56 of the shuttering 53.

Figure 2:
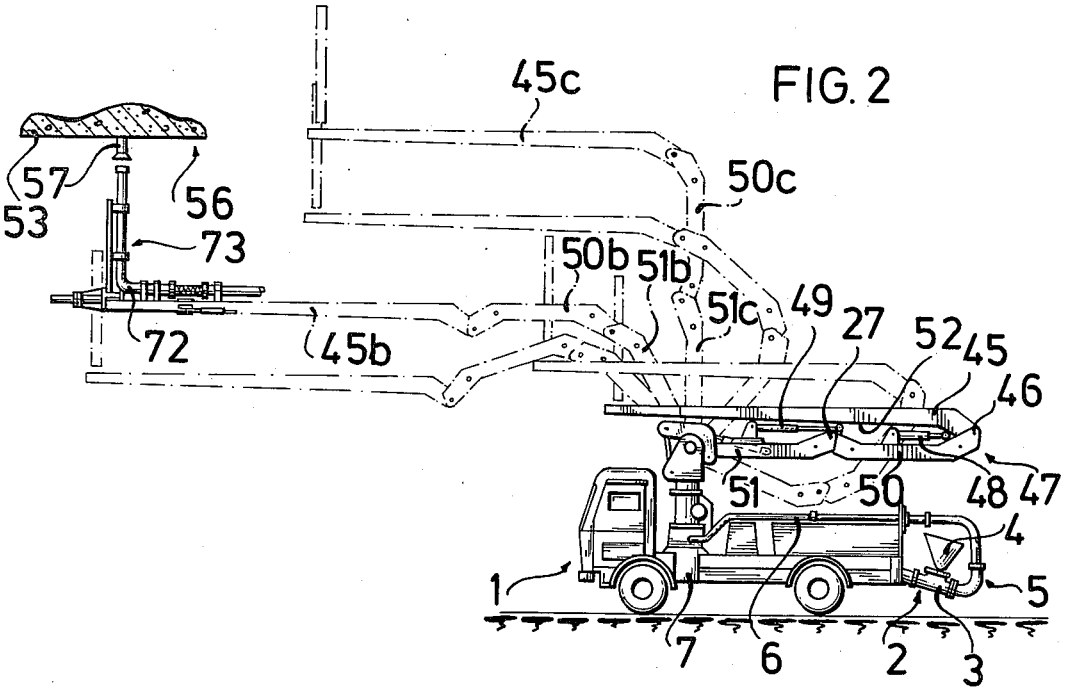
FIG. 2 shows the apparatus of FIG. 1 after displacing the mast column.

FIG. 2 shows, using the reference numerals of FIG. 1, the position of the parts in the event of the height adjustability of the column 7 according to FIG. 8 is used. In addition, a few further intermediate positions are shown in chain lines.

As FIG. 9 shows, on the end of the pipe 14 of the concrete conduit, an S-shaped pipe bend 60 is connected, and from FIG. 1 it can be seen that the concrete conveyor conduit is formed with several rotational joints 61, 62 the swivel axes of which coincide with the respective axes of the corresponding power-operated joints. The sections of the conduit between the rotational joints 61 and 62 are attached to the respective mast sections 50 and 51. Also, the section 63 associated with the swivel extension 45 is fixed to this extension at several places. As best seen in FIG. 5 and 5*a*, there is a flexible joint 65 installed in the front end piece 64 of the concrete conveyor conduit. The flexible joint 65 is driven by a hydraulic ram 66 the cylinder 67 of which is connected to the swivel extension at 68, whilst the piston rod 69 is connected to the front end of a hose 71 at 70, which hose serves as the flexible pipe joint. An end piece 73 angled at 72 is connected to the concrete conveyor conduit, and ends in a nozzle 25. As can be seen from FIG. 5 and FIG. 4, from a position assumed by the vehicle 1 approximately in the middle of the gallery, by suitable deflection 74 of the joint 65, both the right side 78 of the gallery in the vicinity of several filler branches 78*a*, 78*b*, and the left side in the vicinity of several filler branches 79*a* and 79*b* can be reached. Furthermore, with the joint 65 straight, the parts of the shuttering marked with 80 and 81 can be reached.

Figure 4:
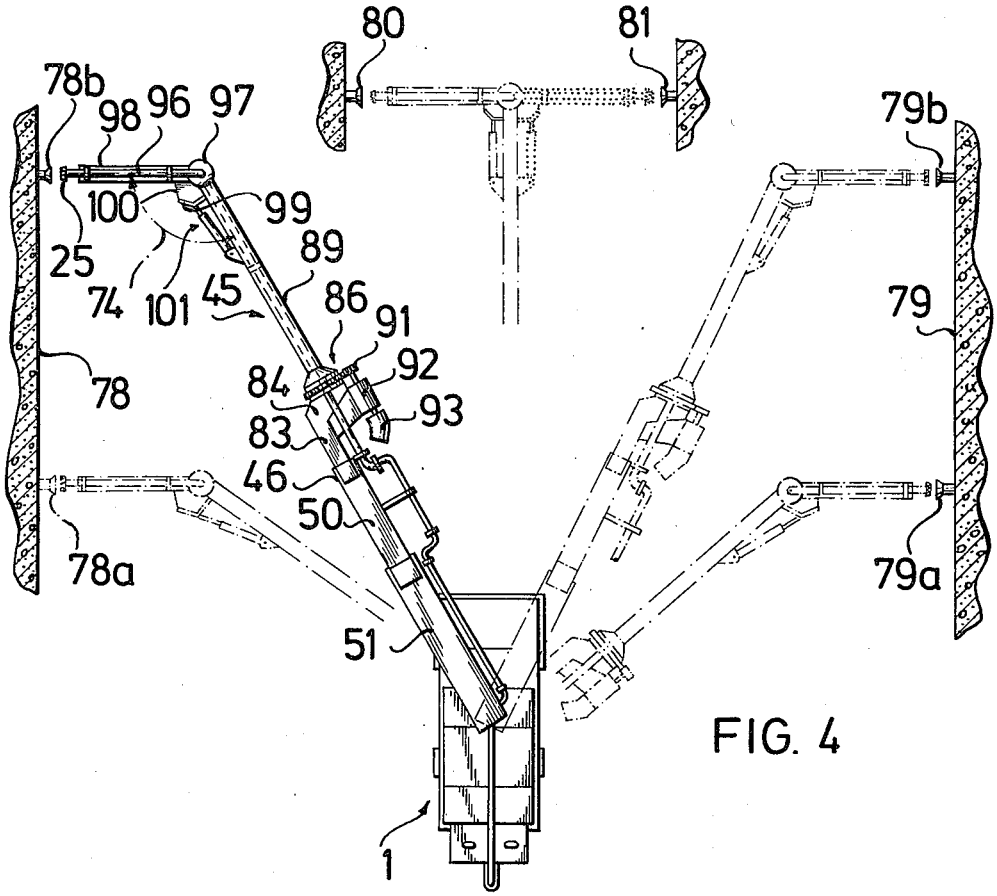
FIG. 4 is a plan view of the apparatus of FIG. 1.
Figure 5:
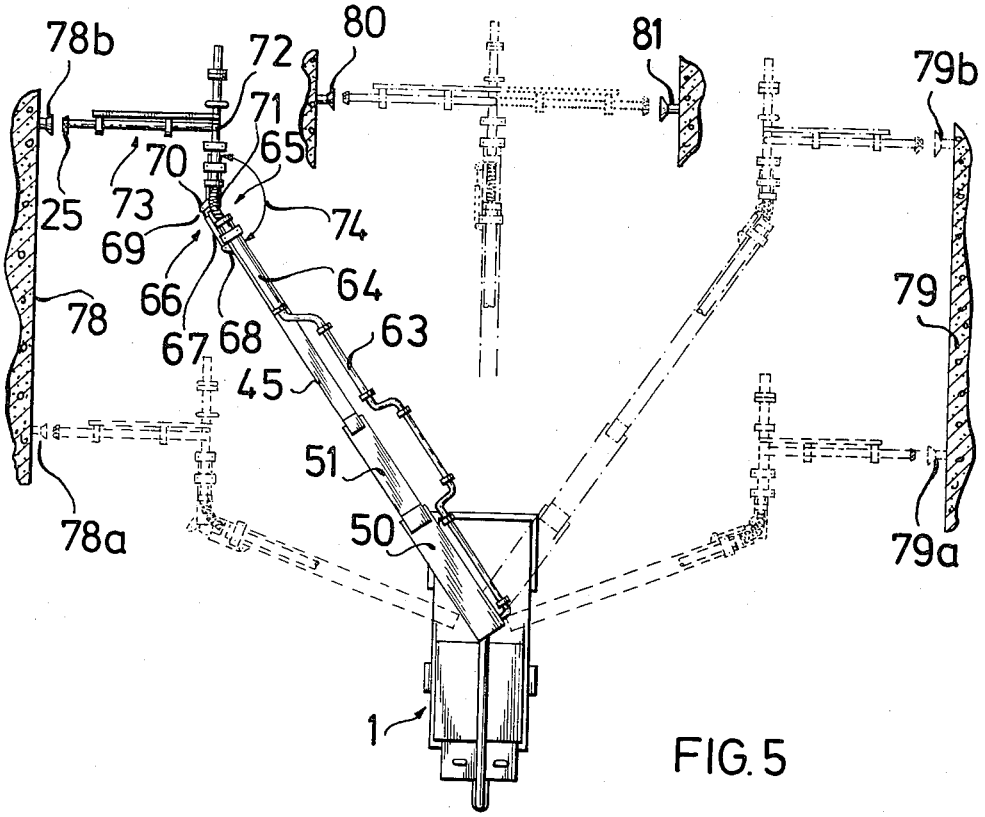
FIG. 5 is a similar view to FIG. 4 of an alternate embodiment.
Figure 5A:
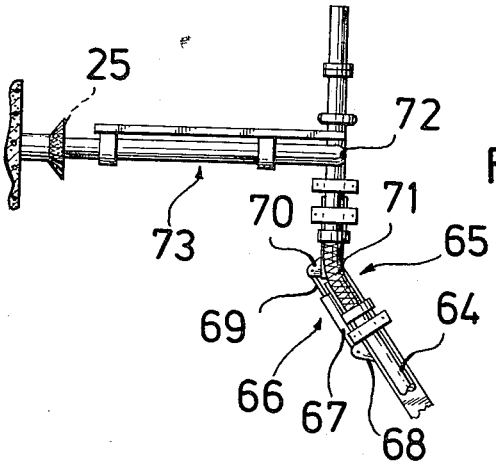
FIG. 5*a* is a detailed view of the flexible joint of FIG. 5.
Figure 6:
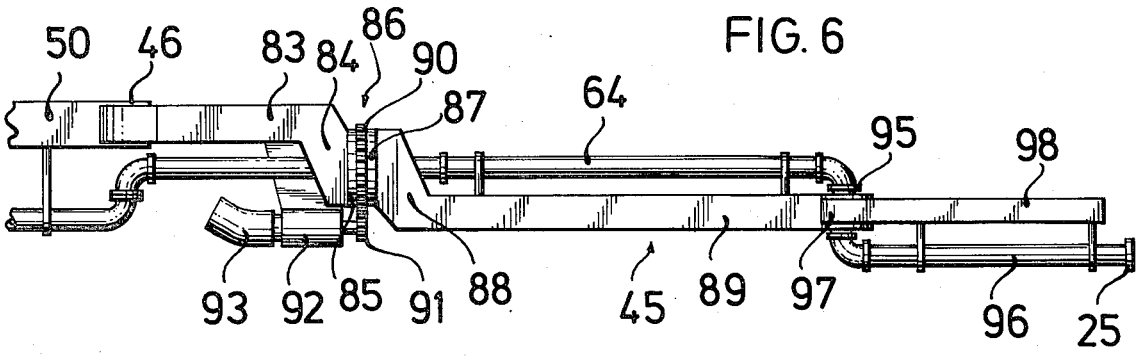
FIG. 6 shows a second alternate embodiment of the invention, in which the swivel extension is shown in plan view.
Figure 6A:
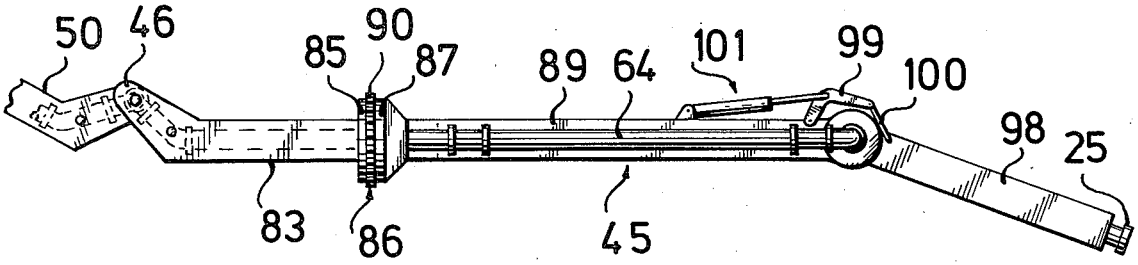
FIG. 6*a* is a top view of FIG. 6.

A further embodiment of the swivel extension 45 is shown in FIG. 4 and FIG. 6 and 6*a*. A first section 83 is connected to the power-operated joint 46 by which the swivel extension is attached to the section 50. The section 83 has an angled extension 84 for positioning the stationary part 85 of a ball bearing rotational ring 86, the rotatable part 87 of which is connected to a correspondingly angled part 88 of a further section 89 of the swivel extension 45. A toothed wheel 90 carried by the rotatable part 87 meshes with a pinion 91 driven by a controllable hydraulic motor 92 which features a feed line 93. The section 64 of the concrete conveyor conduit carried by the swivel extension 45 is led through the axis of the ball bearing rotational ring 86 and provided there with a rotational pipe joint (not shown).

Thus, the ball bearing rotational ring 86 forms a further rotational joint the axis of which is perpendicular to the axes of the joints 27 and 46. The section 64 of the concrete conveyor conduit ends in a rotational pipe joint 95 (FIGS. 6 and 4) which connects the section 64 to the end-piece 96 of the concrete conveyor conduit, the end 25 of which is also shown. The axis of the rotational joint 95 coincides with the rotational axis of a further power-operated joint 97 which again divides the swivel extension 45, so that there is provided an end section 98 of the swivel extension to which the end-piece 96 of the concrete conveyor conduit is attached. The joint 97 is actuated by means of a level 99 and a steering element 100 connected to a controllable ram 101.

Figure 7:
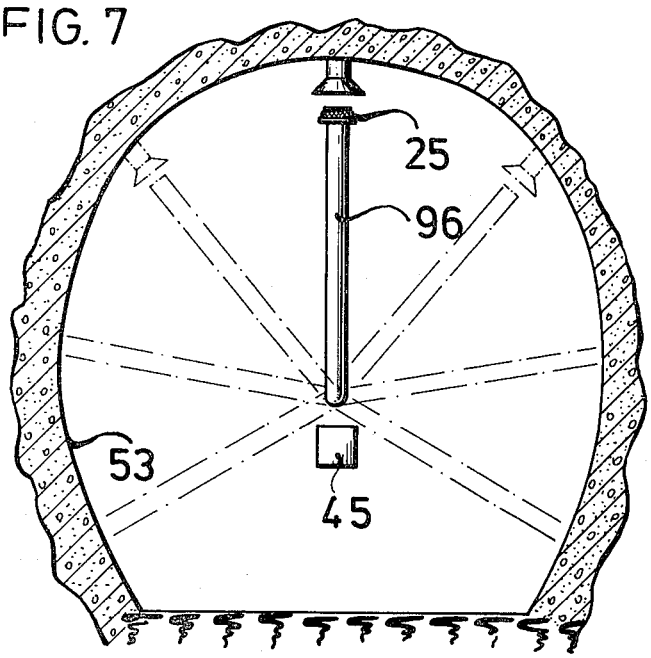
FIG. 7 shows the end piece of the swivel extension in plan to show different operational positions.

As can be seen from FIG. 7, the provision of the rotational joint 86 allows the whole of the peripheral area of the shuttering 53 to be reached with the swivel extension 45 in the position shown, various positions of the end-piece 96 being shown in solid and chain lines.

Figure 3:
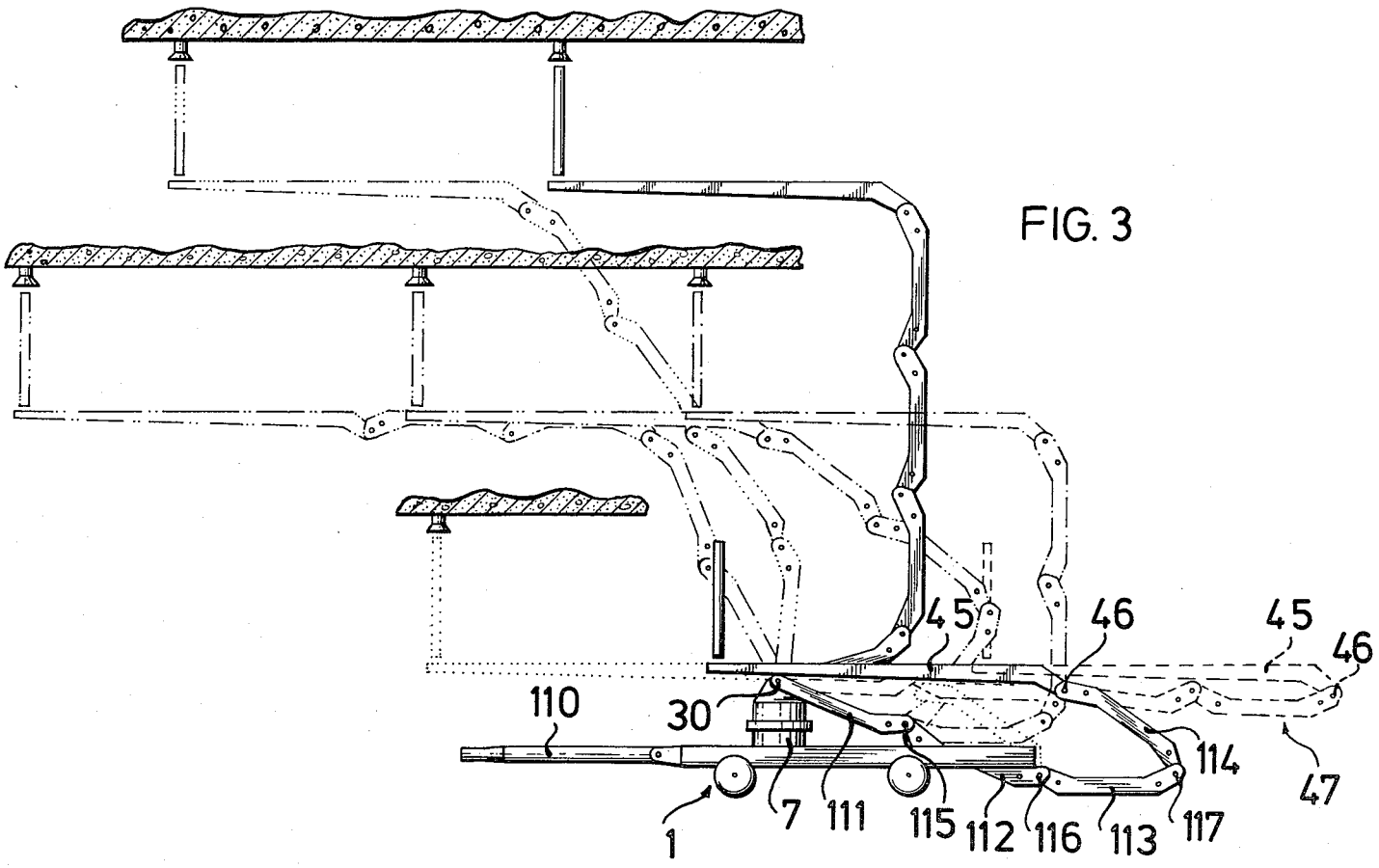
FIG. 3 shows an alternate embodiment of the apparatus shown in FIG. 1.

In the alternate embodiment according to FIG. 3, the vehicle 1 is formed as a rail vehicle which, for example, can be drawn along by a wagon shaft 110. In this embodiment, the column 7 cannot be adjusted for height. However, the main boom consists of four mast sections 111–114 which are connected by power-operated joints 115–117 and attached to the swivel extension 45 and to the column 7 by the power-operated joint 30. The various solid and chain lines showing the various positions of the swivel extension 45 show that, in spite of the relatively great length of mast, only a low height is required to enable it to be unfolded, and yet a plurality of filler openings at different heights in the gallery, and at differing distances from the position of the vehicle 1, can be reached. Also, it can be seen that, in the extended position of the main boom 47, all the power-operated joints 115–117 are disposed below the swivel extension 45 and that the two mast sections 111 and 112 connected to the column can be actuated like the mast sections 50, 51 in the embodiment according to FIG. 1. The subsequently connected mast sections 113 and 114 can be so actuated that they are aligned with the mast sections 111, 112. Also, the mast section 114 can, however, be folded down from above onto the mast section 113. The same is true for the mast sections 113 and 114 with respect to the mast sections 111 and 112.

We claim:

1. A concrete distribution device for use in the shuttering of gallery linings in mines and tunnels, said device mounted on a transportation platform and having an articulated conduit for conveying concrete, said device comprising:

a column vertically mounted onto the transportation platform, said column having a central axis;

a main boom mounted adjacent to said column, said main boom having a first mast section and a second mast section mounted adjacent to said first mast section, second first mast section furter being mounted adjacent to said column;

means for rotatably connecting said main boom to said column such that said main boom is rotatable about said central axis of said column;

first means for pivotably connecting said first mast section to said second mast section;

a swivel extension member mounted adjacent to said second mast section of said main boom;

second means for pivotably connecting said swivel extension member to said mast section of said main boom;

means for folding said main boom relative to said swivel extension member and to said column such that when said main boom is in a folded position, said first pivotably connecting means is disposed between said swivel extension member and the platform; and means for extending said first and second mast sections of said main boom in a confined area from said folded position to an extended position such that said swivel member is extended vertically and horizontally relative to said column.

2. The device according to claim 1, wherein said extending means moves said main boom relative to the platform from a horizontal position to an intermediate position such that said first mast section relative to the platform extends below said horizontal position.

3. The device according to claim 1, further comprising:

means for hydraulically operating said extending means and said folding means for selectively pivoting said first and second mast sections of said main boom and said swivel extension member relative to one another such that said main boom and said swivel extension member are hydraulically movable from said folded position to said extended position and back again.

4. The device according to claim 1, wherein said swivel extension member further having a first section and an opposite end section, said first section connected to said second pivotable connecting means, said first section having a first end and an angled portion connected to said first end, said opposite end section having an angled section and an end portion connected to said angled portion; and said device further comprising:

a rotational joint mounted between said angled portion of said first section and said angled section of said end section of said swivel extension member, said rotational joint having a first end, an opposite end and a swivel axis extending through said first end and said opposite end, said swivel axis further being parallel to the longitudinal axis of said end section of said first section of said swivel extension member, the articulated conduit for conveying concrete attached to said main boom, the articulated conduit further being connected to said first end of said rotational joint for flow communication therebetween, and an end piece conduit connected to said opposite end of said rotational joint for conveying concrete therethrough, said end piece conduit further connected to said end portion of said opposite end section of said swivel extension member for flow communication therebetween, said swivel axis of said rotational joint further being aligned with the longitudinal axis of said end piece conduit, said end piece conduit further being rotationally movable about said swivel axis.

5. The device according to claim 4, wherein said rotational joint in said swivel extension member further having a ball joint connected between said first and said opposite end sections of said swivel extension member, said ball joint further concentrically connecting the concrete conveyor conduit in said rotational joint.

6. The device according to claim 1, further comprising an end portion of the concrete conduit perpendicularly mounted to the said swivel extension member.

7. The device according to claim 1, further comprising means for telescopically extending said column relative to the platform to raise said main boom and said swivel extension member vertically relative to the platform.

* * * * *

UNITED STATES PATENT AND TRADEMARK OFFICE

CERTIFICATE OF CORRECTION

PATENT NO. : 4,280,771

DATED : July 28, 1981

INVENTOR(S) : Friedrich Wilh, et al

It is certified that error appears in the above—identified patent and that said Letters Patent is hereby corrected as shown below:

Column 3, line 32, delete "favourable" and insert ----favorable----.

Column 3, line 55, after "rotational joint" insert a period. Same line, delete "the" and insert ----The----.

Column 4, line 5, delete the comma at the end of the line and insert a period.

Column 4, line 20, delete the comma at the end of the line and insert a period.

Column 6, line 26, delete "whilst" and insert ----while----.

Signed and Sealed this

First Day of December 1981

[SEAL]

Attest:

GERALD J. MOSSINGHOFF

Attesting Officer

Commissioner of Patents and Trademarks